US005230271A

United States Patent [19]

Hardisty et al.

[11] Patent Number: 5,230,271

[45] Date of Patent: Jul. 27, 1993

[54] ROTARY DIE CUTTING APPARATUS

[75] Inventors: Barrie Hardisty, Cheadle Hulme; Robert Collins, Wilmslow, both of England

[73] Assignee: SCM Container Machinery Limited, Stockport, England

[21] Appl. No.: 814,724

[22] Filed: Dec. 27, 1991

Related U.S. Application Data

[63] Continuation-in-part of Ser. No. 597,379, Oct. 10, 1990, abandoned.

[30] Foreign Application Priority Data

Feb. 28, 1990 [GB] United Kingdom ..... 9004513

[51] Int. Cl.[5] ..... B26D 1/12; B26D 7/26

[52] U.S. Cl. ..... 83/698; 83/673; 101/226; 101/389.1

[58] Field of Search ..... 83/659, 665, 670, 673, 83/674, 675, 698; 101/226, 389.1; 29/118; 335/289, 295, 302

[56] References Cited

U.S. PATENT DOCUMENTS 3,745,626 7/1973 Bray ..... 101/389.1 X
3,782,166 1/1974 Whistler, Jr. et al. ..... 83/698 X
3,880,030 4/1975 Rosengren ..... 83/698 X
4,090,162 5/1978 Cardone et al. ..... 335/289
4,233,873 11/1980 Jessen ..... 83/698 X
4,399,482 8/1983 Inoue ..... 335/289 X
4,878,407 11/1989 Harrison et al. ..... 83/698 X

*Primary Examiner*—Frank T. Yost
*Assistant Examiner*—Raymond D. Woods
*Attorney, Agent, or Firm*—Nies, Kurz, Bergert & Tamburro

[57] ABSTRACT

Rotary die cutting apparatus comprising a driven rotary cylinder (10) on which is circumferentially mounted a removable forme (11) having knives (14) projecting radially therefrom. The forme (11) is magnetically retained on the surface of the cylinder (10) by a plurality of longitudinally extending steel bars (15, 16, 17) which locate within grooves (19) in the surface of the cylinder (10), each groove (19) coinciding with a plurality of longitudinally spaced magnets (20) which retain the forme (11) during rotation of the cylinder (10). The grooves (19) and magnets (20) are angularly displaced around the circumference of the cylinder (10) to enable a plurality of forme sections (11) to be mounted thereon according to the length of cut to be performed by the knives (14).

15 Claims, 3 Drawing Sheets

ROTARY DIE CUTTING APPARATUS

This is a continuation-in-part of application Ser. No. 597,379 filed Oct. 10, 1990, now abandoned.

BACKGROUND AND SUMMARY OF INVENTION

This invention concerns rotary die cutting apparatus of the kind comprising a cylinder driven in rotation and carrying on its surface a removable forme having knives projecting radially therefrom. In operation, flat board is transported tangentially past the cylinder so that the knives perform a predetermined cut on the board.

Conventionally, the forme which is usually made from timber and preformed, is attached to the surface of the cylinder by screws which must be aligned with threaded apertures in the cylinder. When it is required to change or replace the forme a lengthy procedure is required to remove and replace a considerable number of screws.

In an alternative arrangement the forme may be mechanically clamped onto the cylinder wall using cumbersome clamping arrangements so that the cylinder requires careful balancing. provide, in rotary die cutting apparatus, a means for removably mounting a forme such that it may be easily and rapidly removed from the cylinder for replacement.

According to the present invention there is provided a rotary die cutting apparatus comprising a driven rotary cylinder, a removable forme circumferentially mounted on the cylinder, and having knives projecting radially outwards therefrom, a plurality of radially inwards facing steel bars attached to the forme and extending longitudinally of the forme parallel to the axis of rotation of the cylinder, radially outwards opening longitudinal grooves in the cylinder to receive said steel bars, and permanent electric holding magnets located in said grooves to retain the forme magnetically on the cylinder, said grooves being spaced around the cylinder on opposed ends of three separate diametral planes, two of said planes being angularly disposed with respect to a plane normal to the third diametral plane, one on each side of said normal plane and displaced therefrom by an angle of not more than 25°.

BRIEF DESCRIPTION OF THE DRAWINGS

An embodiment of the invention will now be described, by way of example only, with reference to the accompanying drawings, in which.

DESCRIPTION OF THE PREFERRED EMBODIMENTS

Figure 1:
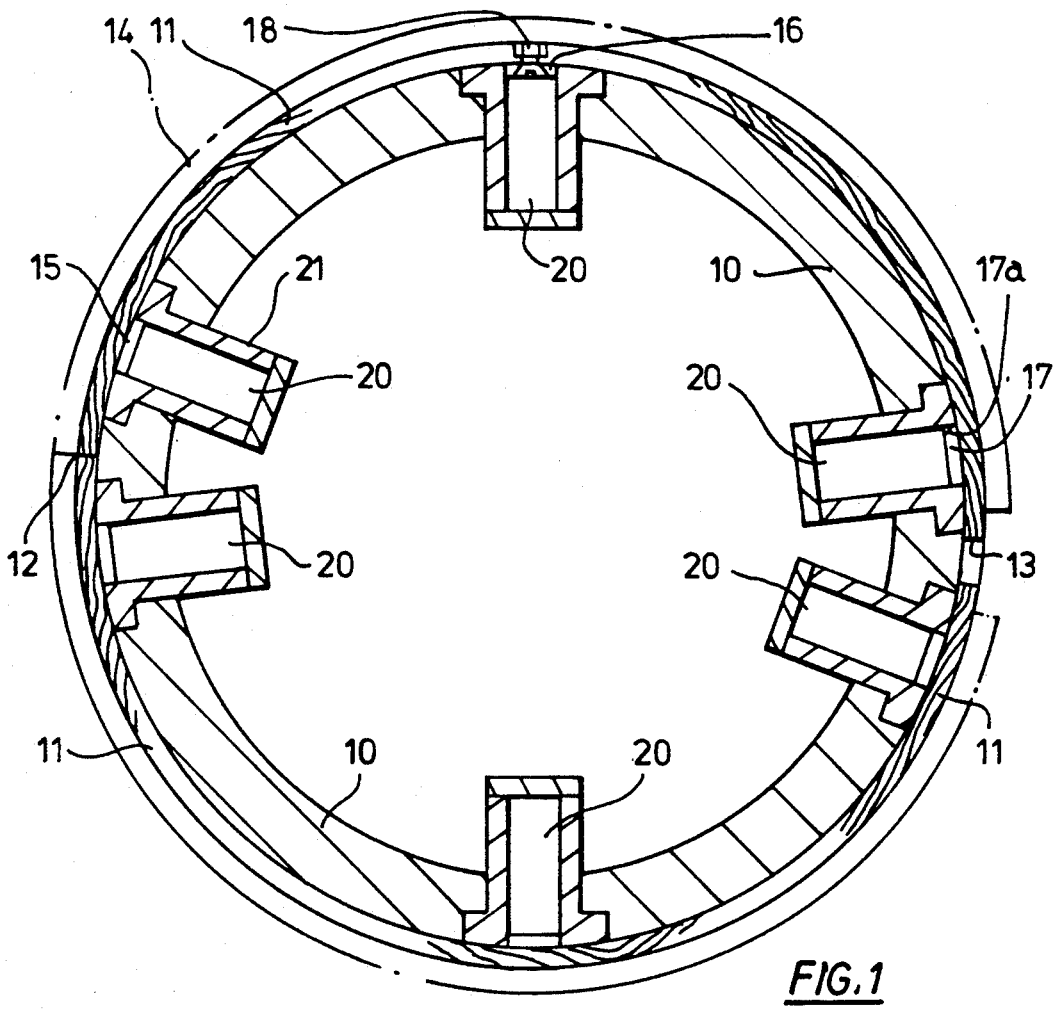
FIG. 1 is a transverse section of a rotary die cutting cylinder and forme, made in accordance with the invention.
Figure 2:
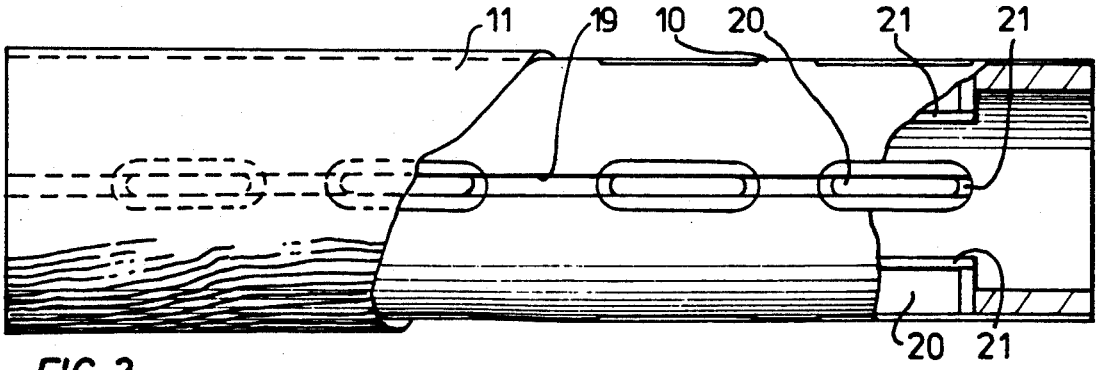
FIG. 2 is a side elevation thereof with parts cut away for the purpose of illustration.

Referring now to FIGS. 1 and 2, in rotary die cutting apparatus there is provided a rotatable cylinder 10 which is driven in rotation by conventional means (not shown) and on which is circumferentially mounted a wooden forme 11 constituted, in FIG. 1, by a pair of separately mounted substantially semi-circular forme sections which are in edge-to-edge angular abutting relationship at one side as illustrated at 12 with a gap 13 at the other side. Each forme section carries, in accordance with a predetermined cutting pattern, an arrangement of radially projecting knives 14.

Extending longitudinally of each forme section on the inner surface thereof are a plurality of spaced steel bars 15, 16 and 17. These may be attached to the forme by countersunk machine screws as illustrated at 18.

The steel bars 15, 16 and 17 are so positioned as to be received within complementary longitudinal groove 19 in the outer surface of the cylinder 10. Coinciding with the grooves 19 at longitudinally spaced positions along the cylinder are a plurality of permanent electric holding magnets 20 retained within housings 21 and arranged to be energized by power means (not shown) external to the cylinder. Such magnets are energized to change their polarity, but may be in an operative or inoperative mode with the power turned off.

The steel bar 17 has one edge chamfered as illustrated at 17*a* such that the forme may be mounted on the cylinder by initially locating bars 15 and 16 in their respective grooves 19, and, by virtue of the flexibility of the forme 11 and the assistance of the chamfered edge 17*a*, finally locating bar 17 in its respective groove.

In operation of the apparatus, the magnets 20 retain the steel bars 15, 16 and 17 in their respective slots 19 to overcome the centrifugal force which would otherwise tend to free the formes from the cylinder 10. Once the magnets are de-energized the forme may be readily removed by initially removing bars 17 from their slots and subsequently the bars 16 and 15.

The forme may consist of one or several part-cylindrical sections according to the required length of cut and may be removed from its associated cylinder in a matter of seconds and replaced so that machine downtime is considerably reduced when compared with the conventional techniques of bolting or clamping formes in place.

It will be seen from FIGS. 1, 3, 4 and 5 that the grooves 19 each containing a number of longitudinally spaced magnets 20 are six in number and are arranged in diametrically opposed pairs. The grooves are spaced around the cylinder on opposite ends of three separate diametral planes consisting of a first diametral plane 22 and two further diametral planes 23 and 24 which are disposed in close angular relationship with a plane 25 normal to the first diametral plane 22. In this way, each of the diametral planes 23 and 24 is within 25° of angular displacement from the normal plane 25.

More precisely, the diametral plane 23 is angularly displaced from the first diametral plane 22 by 83° whilst the diametral plane 24 is angularly displaced therefrom by 70° leaving an acute angle between the two planes 23 and 24 of 27°.

The angular displacement of diametral plane 23 from plane 25 is 7° whilst that of diametral plane 24 therefrom is 20°.

Figure 3:
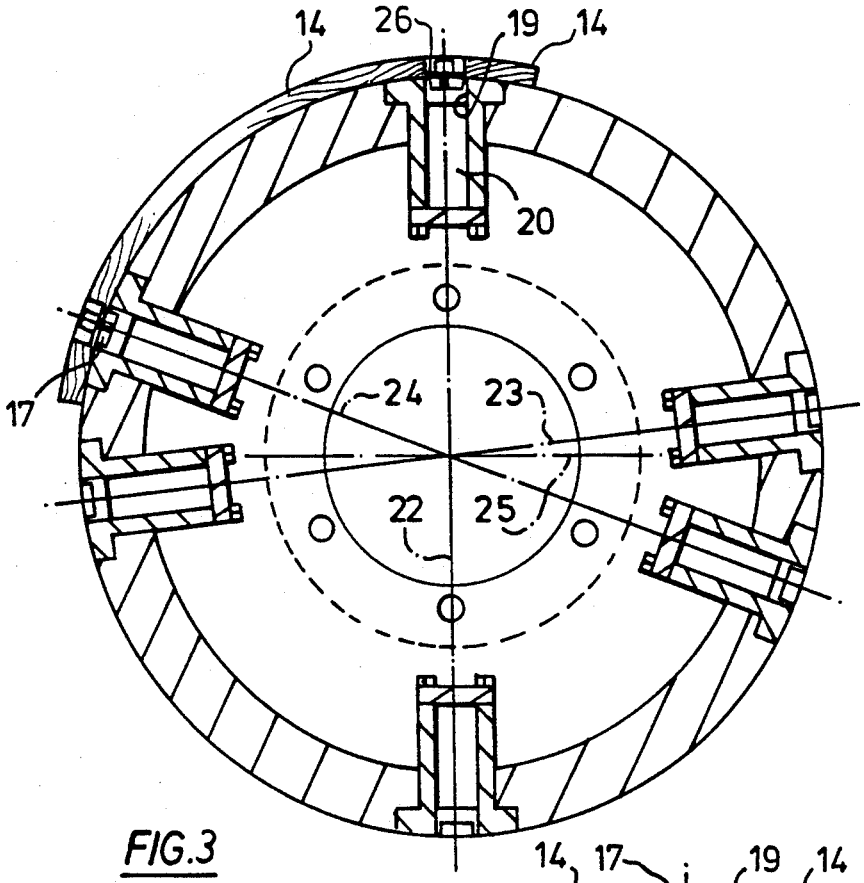
FIG. 3 is a transverse section of the cylinder illustrating a quarter forme mounted thereon.

In FIG. 3 there can be seen a forme which occupies approximately one quarter of the circumference of the cylinder. This configuration would be adopted when only a very short die is required. In this example, a steel bar 26 is fixed beneath one edge region of the forme and occupies substantially the entire width of the adjacent groove 19, while close to the opposite side of the forme a chamfered plate 17 is provided to assist the placement and removal of the forme with respect to the cylinder as described in relation to FIG. 1.

Figure 4:
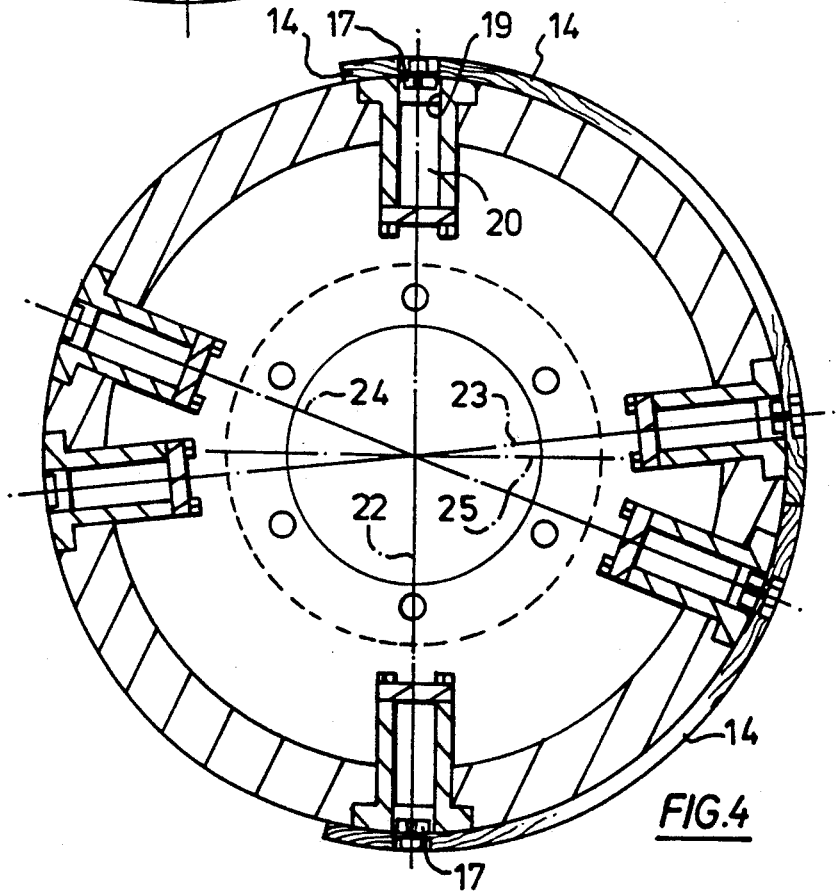
FIG. 4 is a transverse section of the cylinder with two quarter formes mounted thereon in abutting relationship to provide a half forme.

Referring now to FIG. 4 an example is illustrated in which two part-cylindrical forme sections of approximately equal width are disposed on the cylinder in edge-to-edge angular abutting relationship to provide a forme just greater than one half of the circumference of the cylinder. Again, one end of each forme section has a full width bar for location whilst the other end has a chamfered bar.

Figure 5:
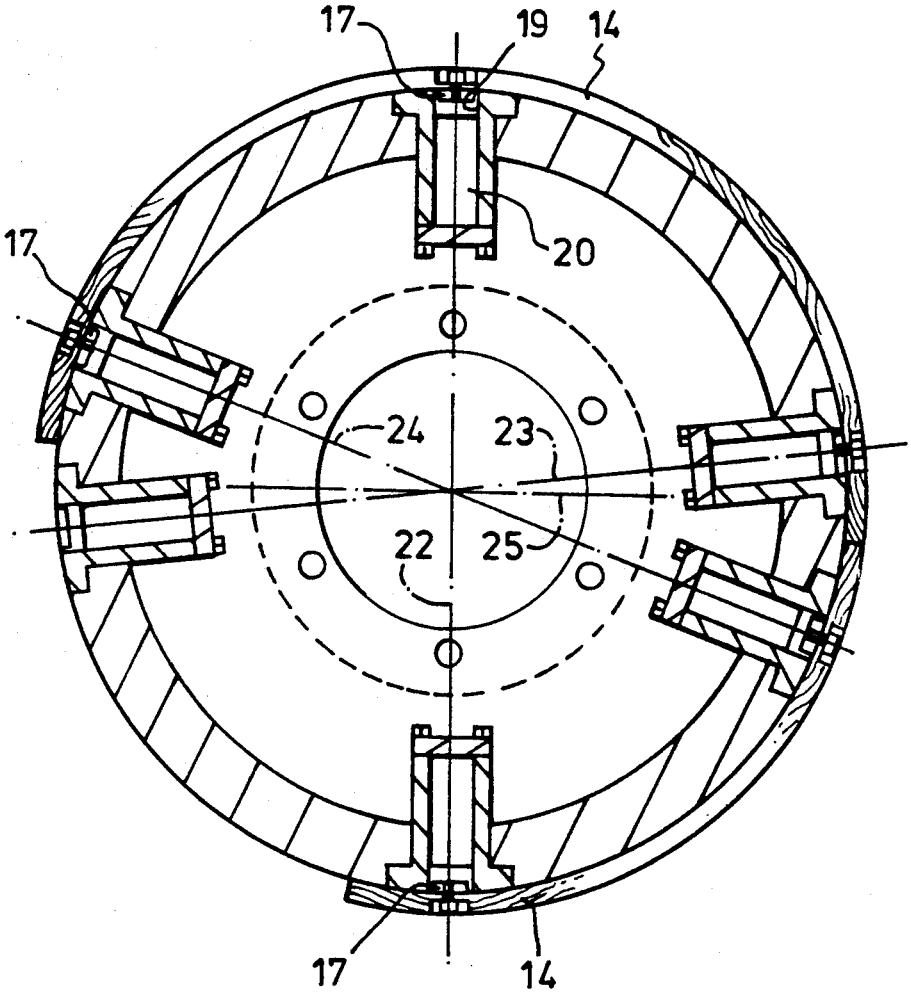
FIG. 5 is a transverse section of the cylinder illustrating a half forme and a quarter forme mounted thereon in angular abutting relationship to provide a three quarters forme.

Referring now to FIG. 5, in another example two forme sections are arranged in edge-to-edge abutting relationship one of which occupies just greater than one half of the circumference of the cylinder whilst the other occupies approximately one quarter, making a three quarters forme in combination. In this example, the half forme section carries a full width steel bar and two chafered bars whilst the quarter forme section, as in FIG. 3, carries one full width bar and one chamfered bar.

Thus, with several combinations of part-cylindrical forme sections a die pattern may occupy substantially any part of the circumference of the cylinder. If the die is to span the entire circumference then an arrangement similar to FIG. 1 will be provided except that he two half formes will be extended to close the gap 13 and to lie substantially in edge-to-edge abutting relationship. It may be necessary to leave a narrow gap to permit the insertion of a tool for removal of the formes when required.

In all cases, each forme section is of a circumferential extent greater than the angular displacement of two spaced grooves and has at least two steel bars for location respectively of said spaced grooves.

We claim:

1. Rotary die cutting apparatus comprising a driven rotary cylinder, a removable forme circumferentially mounted on the cylinder, and having knives projecting radially outwards therefrom, a plurality of radially inwards facing steel bars attached to the forme and extending longitudinally of the forme parallel to the axis of rotation of the cylinder, radially outwards opening longitudinal grooves in the cylinder to receive said steel bars, and permanent electric holding magnets located in said grooves to retain the forme magnetically on the cylinder, said grooves being spaced around the cylinder on opposed ends of three separate diametral planes, two of said planes being angularly disposed with respect to a plane normal to the third diametral plane, one on each side of said normal plane and displaced therefrom by an angle of not more than 25°.

2. Rotary die cutting apparatus according to claim 1, wherein said permanent electric holding magnets are located at longitudinally spaced positions along said outwardly opening longitudinal grooves.

3. Rotary die cutting apparatus according to claim 1, wherein at least one of said steel bars has at least one chamfered longitudinal edge to assist in engagement and disengagement of said bar within and from its associated groove.

4. Rotary die cutting apparatus according to claim 1, wherein said removable forme is divided into a plurality of part-cylindrical forme sections according to a required length of cut to be performed by said knives.

5. Rotary die cutting apparatus according to claim 1, wherein one of said two diametral planes is angularly displaced with respect to said normal plane by 7°.

6. Rotary die cutting apparatus according to claim 1, wherein one of said two diametral planes is angularly disposed with respect to said normal plane by 20°.

7. Rotary die cutting apparatus according to claim 1, wherein one of said two diametral planes is angularly disposed with respect to said third diametral plane by 83°.

8. Rotary die cutting apparatus according to claim 1, wherein one of said two diametral planes is angularly disposed with respect to said third diametral plane by 70°.

9. Rotary die cutting apparatus according to claim 1, wherein said two diametral planes subtend an angle therebetween of 27°.

10. Rotary die cutting apparatus according to claim 1, wherein said forme extends around just greater than a quarter of the circumference of the cylinder.

11. Rotary die cutting apparatus according to claim 4, wherein two part-cylindrical forme sections are provided in edge-to-edge abutting relationship to extend around just greater than one half of the circumference of the cylinder.

12. Rotary die cutting apparatus according to claim 4, wherein said plurality of part cylindrical forme sections comprises a first such section extending around just greater than one half of the circumference of the cylinder and is in edge-to-edge abutting relationship with a further section which extends around just greater than one quarter of the circumference of the cylinder such that the two forme sections together occupy just greater than three quarters of the circumference of the cylinder.

13. Rotary die cutting apparatus according to claim 4, wherein two part-cylindrical forme sections are provided in edge-to-edge abutting relationship to extend around substantially the entire circumference of the cylinder.

14. Rotary die cutting apparatus according to claim 4, wherein each part-cylindrical forme section is of a circumferential extent greater than the angular displacement of two spaced grooves and has at least two radially inwards facing steel bars for location respectively in said grooves.

15. Rotary die cutting apparatus according to claim 1, wherein said two of said planes are angularly disposed at different angles with respect to said plane normal to the third diametral plane.

* * * * *

UNITED STATES PATENT AND TRADEMARK OFFICE

CERTIFICATE OF CORRECTION

PATENT NO. : 5,230,271

DATED : July 27, 1993

INVENTOR(S) : Hardisty et al.

It is certified that error appears in the above-identified patent and that said Letters Patent is hereby corrected as shown below:

Column 1, line 26, before "provide", insert

-- An object of the present invention is to--

Column 3, line 26, correct the spelling of --chamfered--.

Signed and Sealed this

Fifteenth Day of February, 1994

Bruce Lehman

BRUCE LEHMAN

*Commissioner of Patents and Trademarks*

*Attest:*

*Attesting Officer*